US005582659A

United States Patent [19]

Hashimoto et al.

[11] Patent Number: 5,582,659

[45] Date of Patent: Dec. 10, 1996

[54] ALUMINUM ALLOY FOR FORGING, PROCESS FOR CASTING THE SAME AND PROCESS FOR HEAT TREATING THE SAME

[75] Inventors: Akio Hashimoto, Ihara-gun; Sanji Kitaoka, Tokyo; Yoji Namekawa, Tokyo; Kiyoshi Takagi, Tokyo; Hideo Yoshioka, Miura; Ken Kanasashi, Kawasaki, all of Japan

[73] Assignees: Nippon Light Metal Co., Ltd., Tokyo; Nissan Motor Co., Ltd., Kanagawa, both of Japan

[21] Appl. No.: 315,417

[22] Filed: Sep. 29, 1994

[30] Foreign Application Priority Data

Oct. 12, 1993 [JP] Japan ..... 5-254358

[51] Int. Cl.[6] ..... C22F 1/00

[52] U.S. Cl. ..... 148/549; 148/552; 148/691; 148/694; 148/439; 148/440

[58] Field of Search ..... 148/549, 552, 148/691, 694, 698, 440, 439; 420/544

[56] References Cited

U.S. PATENT DOCUMENTS 3,791,876 2/1974 Kroger ..... 148/694

FOREIGN PATENT DOCUMENTS 54-13407 1/1979 Japan .
55-65351 5/1980 Japan .
61-23753 2/1986 Japan .
5-9637 1/1993 Japan .
595531 12/1947 United Kingdom .

*Primary Examiner*—Sikyin Ip
*Attorney, Agent, or Firm*—McAulay Fisher Nissen Goldberg & Kiel, LLP

[57] ABSTRACT

An aluminum alloy for forging comprising from 2.0 to 3.3% by weight of Si, from 0.2 to 0.6% by weight of Mg, from 0.01 to 0.1% by weight of Ti, from 0.0001 to 0.01% by weight of B, up to 0.15% by weight of Fe, one element or at least two elements selected from the group consisting of 0.001 to 0.01% by weight of Na, 0.001 to 0.05% by weight of Sr, 0.05 to 0.15% by weight of Sb and 0.0005 to 0.01% by weight of Ca, up to 0.001% by weight of P, the P/Ca weight ratio being up to 1.0, and the remainder Al, eutectic Si contained in the cast structure of said aluminum alloy having an average particle size of up to 20 μm.

2 Claims, No Drawings

ALUMINUM ALLOY FOR FORGING, PROCESS FOR CASTING THE SAME AND PROCESS FOR HEAT TREATING THE SAME

BACKGROUND OF THE INVENTION

1. Field of the Invention

The present invention relates to an aluminum alloy for forging which is used for automobile parts, electronic appliances, etc., and which exhibits a tensile strength of at least 30 kgf/mm$^2$ and an elongation of at least 15% after forging and subsequent $T_6$-treatment.

2. Description of the Related Art

As a typical material for forging of aluminum alloy, 6061 alloy has been used. Since 6061 alloy is used as a forging material after extrusion, the forging material becomes costly. Moreover, since extruded 6061 alloy is forged, the shapes of the products of the alloy are naturally restricted to simple ones.

Accordingly, the material for forging is required to be prepared by casting when a product having a complicated shape is to be produced. JIS cites AC4C, AC4CH, etc., as materials which can be forged when they have been cast to have a predetermined shape, that is, when they are used as preformed ones. However, aluminum alloys such as AC4C and AC4CH exhibit poor tensile characteristics such as elongation, compared with 6061 alloy, and, therefore, forged products excellent in shape characteristics cannot be obtained therefrom.

Japanese Unexamined Patent Publication (Kokai) No. 54-13407 discloses that to increase the elongation of an aluminum alloy material for forging obtained by casting an aluminum alloy such as AC4C and AC4CH, the eutectic Si is refined by decreasing the Si content to as small as about 3% by weight and adding Na, Sr, Sb, etc.

Although the elongation can be improved to some extent by refining eutectic Si, the elongation of the resultant alloy is still unsatisfactory compared with that of 6061 alloy. As a result, there still remain problems with regard to the forgeability. Moreover, since the forged products thus obtained have an insufficient yield point, they are required to have a thick wall for the purpose of giving them a predetermined structure strength. As a result, the advantages of aluminum materials as lightweight parts cannot be currently utilized.

In view of the current situation as described above, the present inventors have disclosed an aluminum alloy the properties of which are improved by refining eutectic Si in Japanese Unexamined Patent Publication (Kokai) No. 5-9637.

SUMMARY OF THE INVENTION

The present invention has been achieved by improving the invention of the prior application. An object of the present invention is to provide an aluminum alloy excellent in tensile strength and elongation as well as forgeability by controlling the Fe content, the P/Ca ratio, etc., and sufficiently refining eutectic Si.

To accomplish the above object, the aluminum alloy for forging of the present invention comprises from 2.0 to 3.3% by weight of Si, from 0.2 to 0.6% by weight of Mg, from 0.01 to 0.1% by weight of Ti, from 0.0001 to 0.01% by weight of B, up to 0.15% by weight of Fe, one element or at least two elements selected from the group consisting of 0.001 to 0.01% by weight of Na, 0.001 to 0.05% by weight of Sr, 0.05 to 0.15% by weight of Sb and 0.0005 to 0.01% by weight of Ca, up to 0.001% by weight of P provided that the P/Ca weight ratio is up to 1.0 and the remainder Al, eutectic Si contained in the cast structure of said aluminum alloy having an average length of up to 20 μm.

The aluminum alloy for forging of the present invention may further comprise one element or at least two elements selected from the group consisting of 0.2 to 0.5% by weight of Cu, 0.01 to 0.2% by weight of Zr, 0.02 to 0.5% by weight of Mn and 0.01 to 0.3% by weight of Cr.

A molten aluminum alloy prepared to have a predetermined composition is cast by solidifying it at a cooling rate of at least 0.5° C./sec so that the dendrite arm spacing becomes up to 60 μm. The ingot thus obtained is homogenized by heating in a temperature range of 500 ° to 550° C. at a heating rate of up to 50° C./hour in the temperature range of at least 450° C., and holding it in the temperature range for 1 to 24 hours.

Such an aluminum alloy material for forging thus obtained is subjected to heat treatment after forging, that is, it is heated at 540° to 550° C. for 0.5° to 2 hours after forging, water cooled, tempered by heating at 140° to 180° C. for 2° to 20 hours within 6 hours after the water cooling, and air cooled to room temperature.

DESCRIPTION OF THE PREFERRED EMBODIMENT

The Si content of the aluminum alloy for forging of the present invention is determined to be a low value compared with conventional aluminum alloys such as AC4C and AC4CH to ensure forgeability, increase toughness and improve elongation. To refine eutectic Si of the aluminum alloy, Na, Sr, Sb, Ca, etc., are added to the raw material aluminum alloy, and the content of P which is a refining inhibitor element is controlled. With regard to Ca, refining eutectic Si of the aluminum alloy is further promoted by allowing the raw material aluminum alloy to contain Ca as an alloying element under the condition that the P/Ca weight ratio is up to 1.0. The yield point of the aluminum alloy is improved by increasing the amount of Mg to such an extent that a sufficient elongation can be ensured. When a preformed aluminum alloy satisfying the conditions mentioned above is forged, an aluminum alloy having a toughness comparable to that of 6061 alloy can be obtained by plastic working with an upsetting ratio (draft) of as small as about 20%.

The conditions of the present invention such as the alloy components and the alloy contents will be illustrated hereinafter.

Si:

The aluminum alloy for forging of the present invention is obtained as a product having a predetermined shape by forging a preformed material prepared by casting. To obtain the preformed material, the molten alloy is required to exhibit a good flowability and shrinkage, and the cast alloy is required not to form cast cracks. The aluminum alloy is required to contain Si to ensure the castability. However, a large Si content lowers the elongation and mechanical strength. In view of what is mentioned above, the Si content is determined to be in the range of 2.0 to 3.3% by weight.

The Si content in the range mentioned above makes the aluminum alloy attain a necessary elongation and mechanical strength and exhibit excellent castability. When the aluminum alloy has a Si content exceeding 3.3% by weight, it crystallizes a relatively large amount of eutectic Si at grain boundaries which is detected by observing the microstructure, and exhibits a deteriorated elongation, mechanical strength, etc. Conversely, the Si content less than 2.0% by weight makes the castability of the aluminum alloy poor. Particularly when the Si content is from 1 to less than 2% by weight, the aluminum alloy exhibits the worst flowability, and defects such as cast cracks tend to be formed.

Mg:

Mg coexists with Si in the aluminum alloy, and precipitates as $Mg_2Si$ when the aluminum alloy is heat treated. $Mg_2Si$ improves the mechanical strength such as tensile strength and yield point thereof. However, the Mg content exceeding 0.6% by weight markedly lowers the elongation, impact value, etc., thereof. To make the aluminum alloy of the invention have properties close to 6061 alloy, the strength is improved by increasing the Mg content as much as possible so that an increase in the elongation caused by a decrease in the Si content can be covered. To realize such an effect of Mg, the Mg content is required to be at least 0.2% by weight.

Ti, B:

The cast structure of an aluminum alloy is refined by the addition of Ti and B in combination. As the cast structure is refined, impurities, shrinkages, etc., precipitated on the grain boundaries are finely dispersed, whereby the mechanical characteristics are improved. To obtain such an effect, the aluminum alloy of the invention is required to contain at least 0.01% by weight of Ti and at least 0.0001% by weight of B. However, when an aluminum alloy has a Ti content and a B content exceeding 0.1% by weight and 0.01% by weight, respectively, inclusions precipitated therein increase, and the toughness, strength, elongation, etc., are deteriorated.

Fe:

Fe is an impurity contained in an aluminum alloy from the raw material. When an aluminum alloy contains a large amount of Fe, Fe intermetallic compounds are crystallized, and the elongation is lowered. The adverse effects exerted by Fe type crystals are inhibited by controlling the Fe content to be up to 0.15% by weight. Na, Sr, Sb, Ca:

Na, Sr, Sb, Ca, etc., are added to an aluminum alloy to refine eutectic Si and improve the elongation, impact value, etc. Refining eutectic Si is achieved by adding at least 0.001% by weight of Na, at least 0,001% by weight of Sr, at least 0.05% by weight of Sb or at least 0.0005% by weight of Ca. Ca exerts the effect of refining eutectic Si when added under the condition that the P/Ca weight ratio is up to 1.0. However, these addition elements promote the gas adsorption and formation of compounds in the aluminum alloy, and tend to change the shrinkage. As a result, the addition of a large amount of Na, Sr, Sb, Ca, etc., deteriorates the toughness of the aluminum alloy. Accordingly, the upper limits of the contents of Na, Sr, Sb and Ca are determined to be 0.01% by weight, 0.05% by weight, 0.15% by weight and 0.01% by weight, respectively.

P:

Addition elements such as Na, Sr, Sb and Ca react with P in the aluminum alloy, and come not to effectively refine eutectic Si. Accordingly, the content of P which inhibits the refining effect is controlled to be up to 0,001% by weight in the present invention, whereby Na, Sr, Sb, Ca, etc., efficiently display their function.

Cu:

Cu is an element which is added, if necessary, to an aluminum alloy to improve the strength. When from 0.2 to 0.5% by weight of Cu is added with Mg in combination, the yield point of the aluminum alloy is improved while a sufficient elongation is ensured.

Zr, Mn, Cr: Zr, Mn and Cr are elements which are added, if necessary, to an aluminum alloy to prevent the recrystallization thereof during working. For the purpose of preventing the recrystallization, it is necessary that the aluminum alloy should contain at least 0.01% by weight of Zr, at least 0.02% by weight of Mn or at least 0.01% by weight of Cr. However, the addition of these elements in large amounts increases the hardness of the matrix, and lowers the workability. Accordingly, the upper limits of the contents of Zr, Mn and Cr are determined to be 0.2% by weight, 0.5% by 20 weight and 0.3% by weight, respectively.

Average length of eutectic Si:

The aluminum alloy of the present invention contains eutectic Si having an average length of as small as up to 20 μm. The fine eutectic Si increases the elongation of the aluminum alloy material. Moreover, the pores contained in the preformed material are made fine, and the porosity is drastically lowered by forging even at a slight upsetting ratio. The fine eutectic Si thus becomes a factor in obtaining forged products having a high solidity. On the contrary, when the production of forged products having substantially no pores is tried by forging a conventional aluminum alloy, the upsetting ratio is required to be set at at least 50%.

Casting conditions:

The molten aluminum alloy prepared to have a predetermined composition is cast by a procedure such as mold casting and DC casting. The molten aluminum alloy is then required to be solidified at a cooling rate of at least 0.5° C./sec to form a refined cast structure. The cast structure depends on the cooling rate, and the dendrite spacing of a proeutectic s-phase, namely the dendrite arm spacing is made small by a high cooling rate. Accordingly, the degree of refining the cast structure can be obtained by measuring the dendrite arm spacing. An ingot having been solidified by cooling at a rate of at least 0.5° C./sec has a dendrite arm spacing of up to 60 μm, and it has a cast structure in which eutectic Si is sufficiently refined. On the contrary, an ingot having been solidified by cooling at a slow rate of less than 0.5° C./sec has a cast structure in which some of the dendrite arm spacings exceed 60 μm. Large eutectic Si having an average length which exceeds 20 μm is crystallized. Such a coarse structure causes the aluminum alloy material to lower its elongation.

Homogenizing heat treatment of ingot:

When an ingot of an aluminum alloy is subjected to homogenizing treatment, eutectic Si is spheroidized and the alloy components are homogenized. An aluminum alloy material in which eutectic Si is spheroidized exhibits an increase in elongation, and forms no defects such as cracks during forging. As a result, it becomes possible to increase the forging rate of the aluminum alloy, and the productivity is improved.

Spheroidizing eutectic Si actively proceeds as the heat treatment temperature is raised. However, when the heat treatment temperature is overly high, eutectic structure tends to be burnt, and the high temperature causes the aluminum alloy to form cracks. With regard to the heat treatment time, when the heat treatment is carried out for a short period of time, spheroidization of eutectic Si becomes insufficient. When the heat treatment is carried out even for an overly long period of time, the effect on the improvement is not observed. In view of these results, the conditions of homogenizing treatment in the present invention are determined to be as follows: a heat treatment temperature of 500° to 550° C.; and a heat treatment time of 1 to 24 hours.

Moreover, in heating the ingot to a homogenizing temperature, the ingot is required to be heated at a rate of up to 50° C./hour in the temperature range of at least 450° C. When the heating rate exceeds 50° C./hour in the temperature range, the eutectic structure tends to be burnt. However, in the temperature range of less than 450° C., the burning phenomenon of the eutectic structure is not influenced by the heating rate. As a result, the aluminum alloy is preferably heated at a high rate in the temperature range of up to 450° C., and then to a homogenizing temperature of 500° to 550° C. at a rate of up to 50° C./hour.

Heat treatment subsequent to forging:

The forged aluminum alloy is solution treated to redissolve Si particles precipitated within α-crystals in the course of cooling after homogenizing. The solution treatment defined in the present invention is defined to be carried out at a high temperature compared with conventional solution treatment. Accordingly, redissolution of the Si particles within the α-phase can be completed in a short period of time. Moreover, eutectic Si is further spheroidized to contribute to an increase in the elongation. That is, the solution treatment in the present invention is carried out at 540° to 550° C. for 0.5 to 2 hours, whereas the conventional solution treatment is carried out at 520° to 535° C. for 3 ° to 10 hours. The aluminum alloy heated to 540° to 550° C. is water quenched, whereby the precipitation of dissolved Si is prevented. The inhibition of the precipitation of Si particles thus improves the strength of the aluminum alloy.

When the aluminum alloy is maintained in an as water-quenched state, it spontaneously precipitates $Mg_2Si$ and lowers its strength. Accordingly, the aluminum alloy is tempered at 140° to 180° C. for 2 to 20 hours within 6 hours after water quenching to ensure a predetermined strength. When the period of time from water quenching to tempering exceeds 6 hours, the aluminum alloy exhibits a lowered strength caused by the excessive precipitation of $Mg_2Si$, and the mechanical properties thereof become unstable after tempering.

The tempering conditions are determined in view of the mechanical properties required in material designing. For the mechanical properties of a mechanical strength of 30 kgf/mm$^2$ and an elongation of at least 15%, tempering is determined to be carried out at 140° to 180° C. for 2 to 20 hours. When the heating temperature is lower than 140° C., the strength of the aluminum alloy becomes insufficient. When the heating temperature exceeds 180° C. on the contrary, the strength lowers due to overaging. When the heating time is short, namely less than 2 hours, a predetermined effect cannot be obtained. When the heating time exceeds 20 hours, a better effect cannot be observed.

An aluminum alloy having a tensile strength of at least 30 kgf/mm$^2$ and a tensile strength of at least 15% can be stably obtained by the tempering treatment.

EXAMPLE 1

An aluminum alloy material having alloy components as shown in Table 1 was cast using a boat-form mold of JIS No. 4. The mold temperature was 150° C., and the cast alloy was cooled at about 1.5° C./sec.

TABLE 1

Aluminum Alloys Used

| Sample | Alloy components and contests (% by weight) | | | | | | | | | | | | | | |
|---|---|---|---|---|---|---|---|---|---|---|---|---|---|---|---|
| No. | Si | Mg | Ti | B | Fe | Na | Sr | Sb | Ca | P | Cu | Zr | Mn | Cr | P/Ca |
| 1 | 2.5 | 0.4 | 0.02 | 0.006 | 0.1 | 0.005 | — | — | — | 0.0004 | — | — | — | — | — |
| 2 | 2.5 | 0.4 | 0.02 | 0.006 | 0.2 | 0.005 | — | — | — | 0.0004 | — | — | — | — | — |
| 3 | 2.5 | 0.5 | 0.02 | 0.006 | 0.1 | — | 0.006 | — | — | 0.0004 | — | — | — | — | — |
| 4 | 2.5 | 0.5 | 0.02 | 0.006 | 0.1 | — | — | 0.08 | — | 0.0004 | — | — | — | — | — |
| 5 | 2.5 | 0.5 | 0.02 | 0.006 | 0.1 | — | — | — | 0.006 | 0.0004 | — | — | — | — | 0.08 |
| 6 | 2.5 | 0.5 | 0.02 | 0.006 | 0.1 | — | — | — | 0.005 | 0.001 | — | — | — | — | 2 |
| 7 | 2.5 | 0.5 | 0.02 | 0.006 | 0.1 | — | — | — | 0.006 | 0.0005 | 0.4 | — | — | — | 0.08 |
| 8 | 2.5 | 0.5 | 0.02 | 0.006 | 0.1 | — | — | — | 0.006 | 0.0005 | — | 0.02 | — | — | 0.08 |
| 9 | 2.5 | 0.5 | 0.02 | 0.006 | 0.1 | — | — | — | 0.006 | 0.0005 | — | — | 0.3 | — | 0.08 |
| 10 | 2.5 | 0.5 | 0.02 | 0.006 | 0.1 | — | — | — | 0.006 | 0.0005 | — | — | — | 0.2 | 0.08 |

The casting thus obtained was subjected to a tensile test, and the cast structure thereof was observed to obtain an average length of eutectic Si. It is evident from Table 2 which shows the investigation results that the casing (sample No. 2) exhibited an insufficient elongation due to a large content of Fe, and that the casting (sample No. 6) exhibited an insufficient elongation because it had a P/Ca ratio of 2. Eutectic Si of the casting (sample No. 6) had grown much, and had an average length of 25 μm.

TABLE 2

Mechanical Properties and Average Length of Eutectic Si of Castings

| Sample No. | Tensile strength $\sigma_B$ kgf/mm$^2$ | Elongation δ % | Average length of eutectic Si μm |
|---|---|---|---|
| 1 | 18.9 | 18.3 | 18 |
| 2 | 19.7 | 12.5 | 18 |
| 3 | 19.6 | 20.1 | 19 |
| 4 | 21.0 | 19.9 | 20 |
| 5 | 20.3 | 16.7 | 17 |
| 6 | 19.4 | 13.0 | 25 |
| 7 | 22.3 | 15.9 | 18 |
| 8 | 20.0 | 17.0 | 19 |
| 9 | 19.7 | 16.1 | 19 |
| 10 | 19.8 | 16.3 | 20 |

EXAMPLE 2

The dendrite arm spacing of an aluminum alloy material obtained by casting varies depending on the solidification rate of the ingot. When the dendrite arm spacing is overly large, the length of eutectic Si exceeds 20 μm, and, as a result, the elongation of the aluminum alloy is lowered. Furthermore, when a load is applied to the aluminum alloy, fracture, etc., takes place from a starting point on the interface between eutectic Si and the matrix. In the aluminum alloy of the present invention, since eutectic Si is dispersed as fine crystallized materials each having a particle size of up to 20 μm, cracks are not formed therein by forging, and the aluminum alloy can give a solid product having a large elongation.

Table 3 shows the effects of cooling rate on the dendrite arm spacing (DAS) and the average length of eutectic Si, and further shows the effects thereof on the mechanical properties of the casting. In this case, there was employed an aluminum alloy comprising 2.8% by weight of Si, 0.3% by weight of Mg, 0.02% by weight of Ti, 0.006% by weight of B, 0.07% by weight of Fe, 0.006% by weight of Ca and 0.0005% by weight of P (P/Ca ratio of 0.08). In addition, the cooling rate was varied by the following procedures: a boat-form mold of JIS No. 4 was held at 200° C. (cooling condition 1); a boat-form mold was held at 430° C. (cooling condition 2); and the cooling rate was made high by a forging cast process (cooling condition 3).

TABLE 3

| Effects of Cooling Rate | | | | | | |
|---|---|---|---|---|---|---|
| Sample No. | Cooling condi-tion | Cooling rate °C./sec | Eutectic Si μm | DAS μm | Tensile strength $\sigma_B$ kgf/mm$^2$ | Elongation δ % |
| 11 | 1 | 1.0 | 17 | 25 | 21.1 | 15.8 |
| 12 | 2 | 0.4 | 35 | 65 | 21.5 | 12.1 |
| 13 | 3 | 3.0 | 14 | 12 | 22.7 | 20.3 |

Note:
Cooling condition 1: A mold was held at 200° C.
Cooling condition 2: A mold was held at 430° C.
Cooling condition 3: A forging cast process was adopted.
DAS = Dendrite arm spacing It is evident from Table 3 that the dendrite arm spacing became large and eutectic Si grew large in the casting (sample No. 12) which had been cooled at a low rate, and that the casting exhibited a low elongation. In contrast to the casting, the casting (sample No. 13) which had been cooled at a high rate exhibited an extremely large elongation. From the results mentioned above, it is confirmed that refining the dendrite spacing and eutectic Si improved the elongation.

EXAMPLE 3

The casting (sample No. 11) was homogenized, and the effects of the heat treatment conditions on the mechanical properties thereof were investigated. In addition, in homogenizing the casting, the heating rate was set at 30° C./hour in the temperature region of at least 450° C. so that eutectic Si was not burnt. Moreover, when heating the casting at a homogenizing temperature was finished, the casting was cooled at a rate of 1.0° C./sec.

TABLE 4

| Effects of Homogenizing | | | | |
|---|---|---|---|---|
| Sample | Homogenizing | | Tensile strength $\sigma_B$ | Elongation δ |
| No. | Temp. °C. | Hour | kgf/mm$^2$ | % |
| 14 | 525 | 6 | 18.0 | 18.8 |
| 15 | 480 | 6 | 18.7 | 16.0 |
| 16 | 555 | 6 | 17.0 | 9.7 |
| 17 | 525 | 0.5 | 19.0 | 16.3 |

It is evident from Table 4 that the casting (sample No. 15) having been heated to a relatively low temperature exhibited an insufficient elongation due to insufficient homogenizing. The casting (sample No. 16) having been heated to a high temperature exhibited an extremely low elongation due to the occurrence of burning. Moreover, a casting even having been heated to an appropriate temperature did not exhibit a sufficient elongation when having been homogenized for a short period of time as observed in the casting (sample No. 17). In contrast to the casting (sample No. 17), the casting (sample No. 14) exhibited a high tensile strength and elongation after homogenizing.

EXAMPLE 4

The casting (sample No. 14) having been homogenized was preheated by heating at 400° C. for 1 hour, forged at an upsetting ratio of 20%, and T6 treated. A test piece was cut out from the forging thus obtained, and a tensile test was carried out thereon. Table 5 shows the test results.

TABLE 5

Effect of T6 Treatment on Properties of Forgings

| Sample | Soln. treatment | | Time until | Artificial aging | | Tensile strength $\sigma_B$ | Elongation $\delta$ |
|---|---|---|---|---|---|---|---|
| No. | Temp. °C. | Hour | tempering* | Temp. °C. | Hour | kgf/mm$^2$ | % |
| 18 | 545 | 1 | 3 | 150 | 6 | 33.8 | 23.1 |
| 19 | 530 | 1 | 3 | 150 | 6 | 32.5 | 14.8 |
| 20 | 545 | 3 | 3 | 150 | 6 | 33.4 | 23.3 |
| 21 | 545 | 1 | 10 | 150 | 6 | 30.8 | 23.4 |
| 22 | 545 | 1 | 3 | 200 | 6 | 27.6 | 14.2 |
| 23 | 545 | 1 | 3 | 150 | 1 | 26.2 | 15.5 |

Note:
Soln. = Solution
*Time from finishing solution treatment to starting tempering The forging (sample No. 18 ) having been $T_6$ treated according to the present invention showed a tensile strength of at least 30 kgf/mm$^2$ and an elongation of at least 15%. The forging (sample No. 19) having been solution treated at a low temperature showed a low elongation. The forging (sample No. 20) showed about the same elongation as the forging (sample No. 18) though the former forging had been solution treated for a long time. Accordingly, the improvement of the properties of the forging (sample No. 20 ) did not correspond to the treatment time. The forging (sample No. 21) had a somewhat low strength compared with the forging (sample No. 18), and the time from finishing solution treatment to starting tempering was long. Accordingly, the processability of the forging (sample No. 21) was poor. Since the forging (sample No. 22) having been tempered at an overly high temperature exhibited an overaging phenomenon, both the tensile strength and the elongation thereof lowered. Moreover, the forging (sample No. 23) giving been tempered for an overly short period of time exhibited an insufficient strength.

As illustrated above, in the aluminum alloy for forging of the present invention, the elongation is improved decreasing the Si content until the aluminum alloy can be used as a casting, and the mechanical strength is ensured by refining the crystal grains and crystallized materials. Moreover, since eutectic Si contained in the casting is refined, the casting exhibits good forgeability, and gives products having a high solidity and good mechanical characteristics at only a small upsetting ratio.

We claim:

1. A process for producing an aluminum alloy for forging, comprising the steps of:

casting an aluminum alloy which consists essentially of from 2.0 to 3.3% by weight of Si, from 0.2 to 0.6% by weight of Mg, from 0.01 to 0.1% by weight of Ti, from 0.0001 to 0.01% by weight of B, up to 0.15% by weight of Fe, at least one element selected from the group consisting of 0.001 to 0.01% by weight of Na, 0.001 to 0.05% by weight of Sr, 0.05 to 0.15% by weight of Sb and 0.0005 to 0.01% by weight of Ca, up to 0.001% by weight of P, the P/Ca weight ratio being up to 1.0, and the remainder Al by solidifying a melt of said aluminum alloy at a cooling rate of at least 0.5° C./sec to form an ingot of said aluminum alloy having a dendrite arm spacing of up to 60 μm;

homogenizing said ingot of said aluminum alloy by heating in a temperature range of 500° to 550° C. for 1 to 24 hours under a condition that the heating rate of said ingot is up to 50° C./hour in a temperature range of at least 450° C.;

forging, after said homogenizing, said ingot to form a forging;

heating said forging in a temperature range of 540° to 550° C. for 0.5 to 2 hours;

water quenching said forging after said heating; and tempering, within 6 hours after said water quenching, said forging by heating in a temperature range of 140° to 180° C. for 2 to 20 hours.

2. A process for producing an aluminum alloy for forging, comprising the steps of:

casting an aluminum alloy which consists essentially of comprises from 2.0 to 3.3% by weight of Si, from 0.2 to 0.6% by weight of Mg, from 0.01 to 0.01 by weight of Ti, from 0.0001 to 0.01% by weight of B, up to 0.15% by weight of Fe, at least one element selected from the group consisting of 0.001 to 0.01% by weight of Na, 0.001 to 0.05% by weight of Sr, 0.05 to 0.15% by weight of Sb and 0.0005 to 0.01% by weight of Ca, at least one element selected from the group consisting of 0.2 to 0.5% by weight of Cu, 0.01 to 0.2% by weight of Zr, 0.02 to 0.5% by weight of Mn and 0.01 to 0.3% by weight of Cr, up to 0.001% by weight of P, the P/Ca weight ratio being up to 1.0, and the remainder Al, by solidifying a melt of said aluminum alloy at a cooling rate of at least 0.5° C./sec to form an ingot of said aluminum alloy having a dendrite arm spacing of up to 60 μm;

homogenizing said ingot of said aluminum alloy by heating in a temperature range of 500° to 550° C. for 1 to 24 hours under a condition that the heating rate of said ingot is up to 50° C./hour in a temperature range of at least 450° C.;

forging, after said homogenizing, said ingot to form a forging;

heating said forging in a temperature range of 540° to 550° C. for 0.5 to 2 hours;

water quenching said forging after said heating; and tempering, within 6 hours after said water quenching, said forging by heating in a temperature range of 140° to 180° C. for 2 to 20 hours.

* * * * *